United States Patent [19]

Reinwald et al.

[11] 4,164,430

[45] Aug. 14, 1979

[54] METHOD OF WASHING MATERIALS WHILE REVERSIBLY CIRCULATING WASH LIQUID THROUGH A CATION EXCHANGE RESIN

[75] Inventors: Elmar Reinwald, Dusseldorf; Heinz Smolka, Langenfeld; Milan J. Schwuger, Haan, all of Fed. Rep. of Germany

[73] Assignee: Henkel Kommanditgesellschaft auf Aktien, Dusseldorf-Holthausen, Fed. Rep. of Germany

[21] Appl. No.: 852,029

[22] Filed: Nov. 16, 1977

[30] Foreign Application Priority Data

Dec. 1, 1976 [DE] Fed. Rep. of Germany ..... 2654353

[51] Int. Cl.[2] ..... B08B 7/04

[52] U.S. Cl. ..... 134/13; 8/137; 68/13 A; 134/109

[58] Field of Search ..... 134/13, 34, 109, 111; 68/13 A; 252/176; 210/35, 38 A, 266, 275, 291; 8/137

[56] References Cited

U.S. PATENT DOCUMENTS

| | | | |
|---|---|---|---|
| 1,450,054 | 3/1923 | Titus | 68/13 A |
| 3,023,132 | 2/1962 | Diamond et al. | 68/13 A X |
| 3,339,737 | 9/1967 | Kiscellus et al. | 68/13 A X |
| 3,424,545 | 1/1969 | Bauman | 8/137 |
| 3,436,343 | 4/1969 | Smith | 210/35 X |
| 3,476,600 | 11/1969 | Morgan et al. | 134/111 X |
| 4,043,833 | 8/1977 | Plura | 134/111 X |

FOREIGN PATENT DOCUMENTS

| | | |
|---|---|---|
| 2307923 | 10/1973 | Fed. Rep. of Germany . |
| 2216467 | 4/1974 | Fed. Rep. of Germany . |
| 2411466 | 10/1974 | Fed. Rep. of Germany . |

*Primary Examiner*—Marc L. Caroff

*Attorney, Agent, or Firm*—Hammond & Littell

[57] ABSTRACT

Solid soiled materials are machine washed by withdrawing and recycling the wash liquor in contact with said solid soiled materials through a water-insoluble cation exchange polymer in particulate state having a calcium binding power of at least 2 mVal per gram, said polymer in particulate state being maintained out of contact with said solid soiled materials, for such time that the recycling wash liquor has passed through said polymer at least twice, in the presence of other soluble washing and cleaning compounds, while reversing the direction of flow of said wash liquor through said polymer repeatedly.

9 Claims, 4 Drawing Figures

FIG. I
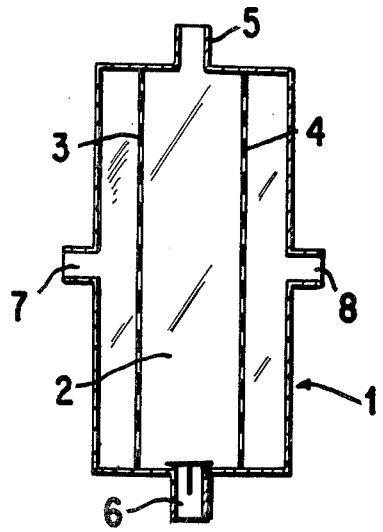
FIG. II
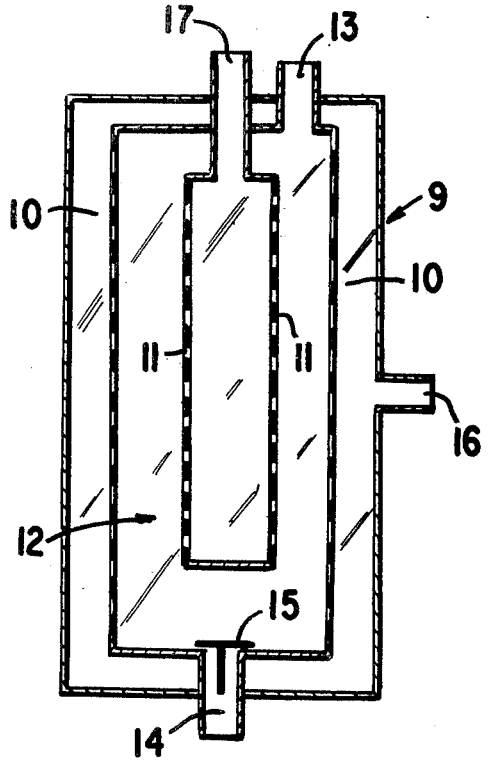

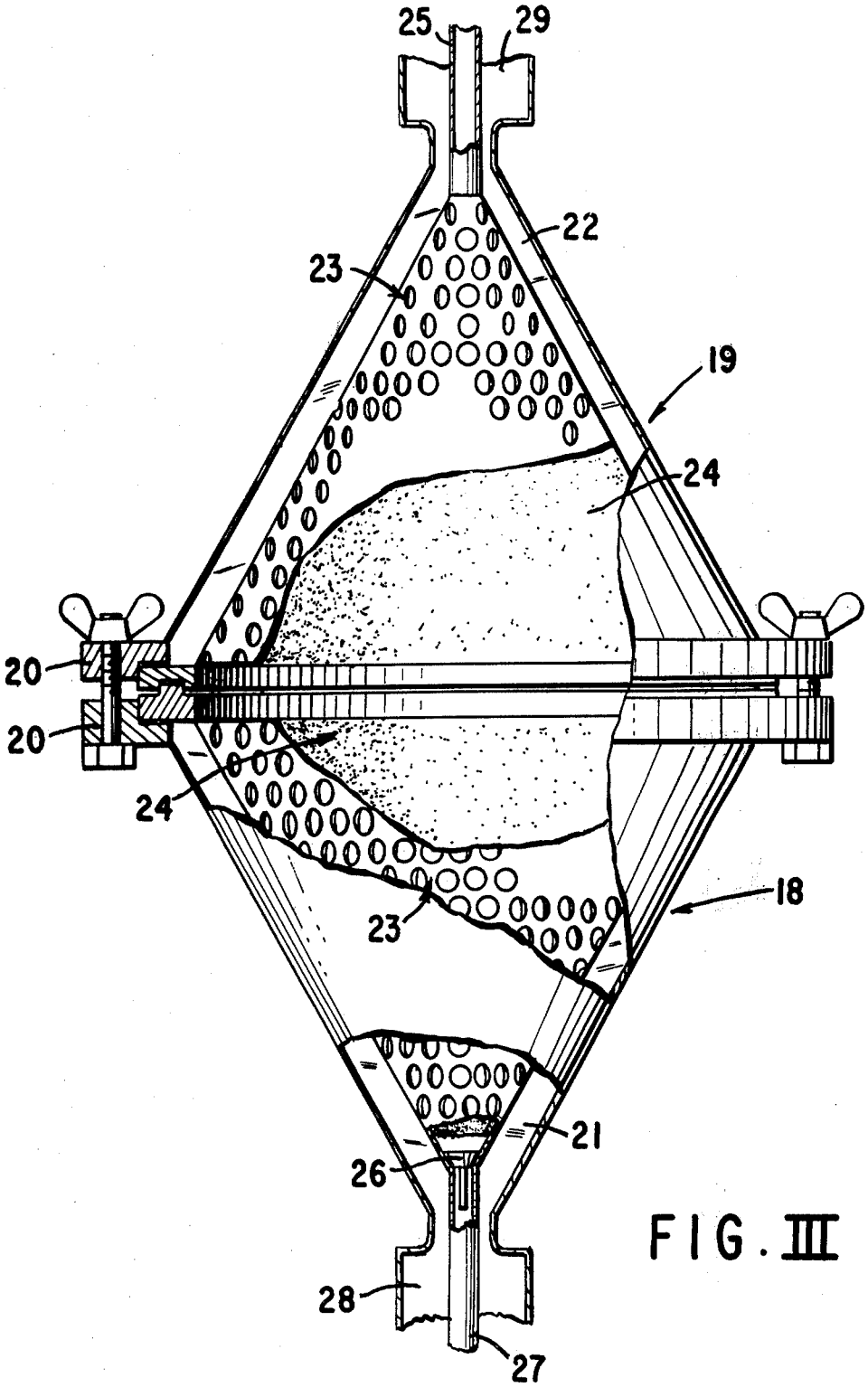
FIG. III

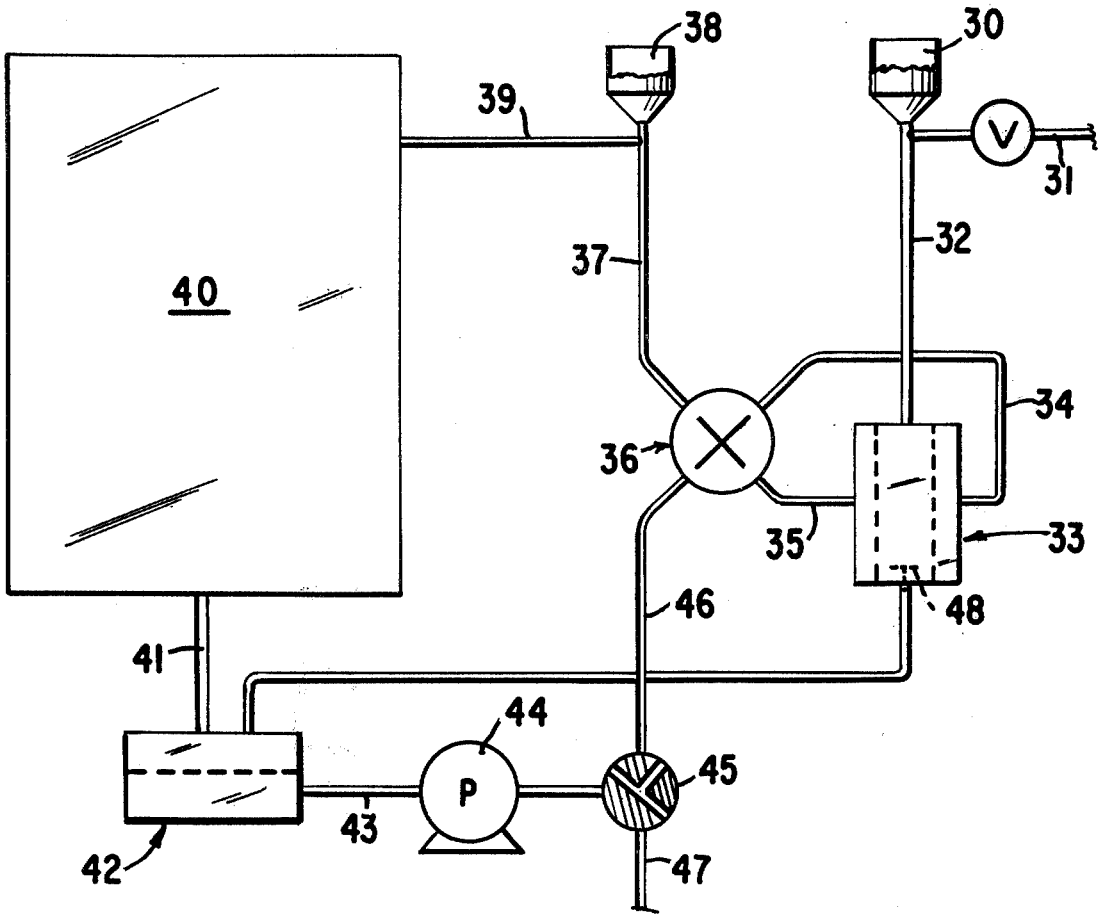
FIG. IV

METHOD OF WASHING MATERIALS WHILE REVERSIBLY CIRCULATING WASH LIQUID THROUGH A CATION EXCHANGE RESIN

THE RELATED ART

Washing methods are known where the washing solution is circulated continuously during the washing process and conducted through one or more vessels in which the entrained dirt particles can settle from the wash water liquor before it is returned into the washing process. It has already been suggested to place screens or filters in the liquid circuit to retain coarse impurities or objects which could damage the mechanism. But since the bulk of the dirt is usually dissolved or dispersed in very finely divided form in the solution, the cleaning or regeneration of the solution is inadequate this way, and savings in certain washing and cleaning ingredients, for example, polymeric phosphates, cannot be achieved without a simultaneous decrease in the cleaning results.

In commercial laundries it is customary to prepare the washing solution with softened water, to which end the water to be used is first treated with an ion-exchange compound (e.g., a zeolite). But soft water has not sufficient washing power, even in the presence of surface-active substances to clean textiles and dishes in the absence of builders.

The problem is particularly serious when the articles to be washed carry soil which contains hardness formers, as pre-treatment of the wash water does not affect the hardness thereby introduced. This results in progressive incrustation of the material being washed.

Furthermore it has been suggested to effect the washing process in the presence of ion-exchangers based on organic polymers, which are added to the washing solution either in the form of a textile or as granular or powdered resins. But textile-type ion-exchangers have only a relatively low ion-exchange capacity, so that large amounts of the ion-exchange textile are required. Almost any amount of hardness is detrimental to washing solutions which contain an anionic detergent, and in most areas where hardness is a significant problem, it is necessary to decrease the hardness of the water by at least 50%. The space occupied by the ion-exchanger is at the expense of the material to be cleaned. Granular or powdered ion-exchange agents become caught in fabrics or garments being washed unless special precautions are taken, and the particles are difficult to recover when the washing operation is completed. If, as has likewise been suggested, the ion-exchange resin is enclosed in a gauze bag to prevent the agent from depositing on the textile fibers, the cleaning effect of the washing solution is considerably decreased.

U.S. patent application Ser. No. 639,465, filed Dec. 10, 1975, now abandoned in favor of its continuation application Ser. No. 821,968, filed Aug. 4, 1977, discloses a method of machine washing and cleaning of solid materials with the use of low-phosphate or phosphate-free washing and cleaning solutions in the presence of water-insoluble cation exchangers which are able to bind the hardness formers of the water and of the impurities, characterized in that the cation exchanger has a calcium binding capacity of at least 2 mVal/gm and consists of a copolymer or graft polymer of olefinically-unsaturated monocarboxylic acids and/or polycarboxylic acids where the wash liquor contains 0.05 to 2 gm/liter of water-soluble calcium ion-binding complex formers and where the wash liquid is passed continuously or intermittently through an adsorption device which is adapted to separate the cation exchanger from the wash liquid.

According to this application, the washing and cleaning process can be performed, for example, by first adding a sufficient amount of the cation exchanger into the adsorption device, charging the washing area with the soiled solid material to be washed, and then dissolving the washing or cleaning agent in the water charged where the cation exchanger is in the adsorption device, already before the addition of the material to be washed or cleaned, thereby excluding direct contact of the material to be cleaned with the insoluble ion-exchanger. The fresh water thus comes into contact first with the cleaning agent, before it comes in contact with the material to be cleaned and thereafter with the cation exchanger.

Suitable absorption devices for the process of this prior art are, in addition to simple plate filters and filter cartridges, which may optionally be charged with filter aids to improve the efficiency of the filter and to avoid clogging of the filter pores, the so-called fluid bed or whirlpool filters as a preferred embodiment.

In this filter type, the liquid to be filtered enters the interior of the filter chamber tangentially and thus maintains the ion exchanger in particulate form to be separated in continuous whirling motion. This greatly reduces the danger of the filter pores clogging and the liquid circulation, which is vital for a good laundry result, being throttled or even suppressed. Nevertheless, in the presence of relatively large quantities of finely-divided dirt particles, or when using especially active ion exchanger with a high percentage of finely pulverized material, difficulties may arise. These can be obviated by intermittently reversing the flow direction, but then it must be accepted that a part of the ion exchanger already separated or of the filtered dirt substances are flushed back into the laundry tub, owing to which the washing process as a whole will be lengthened and will require frequent rinsing. This disadvantage can be circumvented by using the ion exchanger in the form of a lumpy material or a filter cartridge or filter plate, which will remain in the adsorption device even if the flow is reversed. However, due to the reduced effective surface, in the case of coarse-grained or lumpy material, the cation exchange is retarded or more sluggish and the washing process is lengthened proportionately. Moreover, the production of porous filter plates and cartridges is comparatively expensive.

OBJECTS OF THE INVENTION

An object of the present invention is the development of a process for washing solid soiled materials employing smaller particle sized cation exchange polymers wherein an enhanced washing effect is had without clogging the filter pores.

Another object of the present invention is the development of a method for machine washing and cleaning of solid materials utilizing washing and cleaning solutions in the presence of water-insoluble cation exchange agents which are capable of binding the hardness components of the water and the soil, comprising withdrawing and recycling the wash liquid in contact with said solid soiled materials through a water-insoluble cation exchange copolymer in particulate state having a swelled average particle size of between 10μ and 2000μ and having a calcium binding power of at least 2 mVal/gm, said copolymer being a copolymer or graft polymer derived from mono-olefinically-unsaturated carboxylic acids, said cation exchange copolymer being maintained completely out of contact with said solid soiled materials in a separate area from the washing area, said wash liquor at some time during said recycling containing soluble washing and cleaning compounds and washing said solid materials while continuing the recycling of the wash liquor through said cation exchange copolymer, wherein the total amount of washing liquor is continuously or intermittently cyclically circulated from the washing area through the separate area with the cation exchange copolymer and then back to the washing area at least five times during the cleaning process, and during this period the direction of flow of said wash liquor through said cation exchange copolymer is reversed repeatedly, and where the amount of the cation exchange copolymer is sufficient to substantially soften the washing solution, and said washing solution contains from 0.2 to 10 gm/liter of other soluble washing and cleaning compounds including from 0.05 to 2 gm per liter of a water-soluble calcium-binding sequestrant, whereby said cation exchange copolymer is never in contact with said solid materials.

These and other objects of the present invention will become more apparent as the description thereof proceeds.

THE DRAWINGS

FIG. I is a diagrammatic cross-section of one embodiment of a filter employed in the process of the invention.

FIG. II is a diagrammatic cross-section of another embodiment of a filter employed in the process of the invention.

FIG. III is a partial cross-section of another embodiment of a filter employed in the process of the invention.

FIG. IV is a flow diagram of the process according to the invention.

DESCRIPTION OF THE INVENTION

We have now found that the cleaning results as described in Ser. Nos. 639,465 and 821,968 can be further enhanced by proceeding in the manner described below. The subject of the invention is a method according to Ser. Nos. 639,465 and 821,968, characterized in that, before the start of the washing process, the cation exchanger copolymer present in powdery or fine grain form is transferred into a filter area completely separate from the washing area and during the washing process, the flow direction of the wash liquor passing through the filter area is reversed repeatedly.

More particularly, the present invention relates to a method for machine washing and cleaning of solid materials utilizing washing and cleaning solutions in the presence of water-insoluble cation exchange agents which are capable of binding the hardness components of the water and the soil, comprising withdrawing and recycling the wash liquor in contact with said solid soiled materials through water-insoluble cation exchange copolymer in particulate state having a swelled average particle size of between 10μ and 2000μ and having a calcium binding power of at least 2 mVal/gm, said copolymer being a copolymer or graft polymer derived from mono-olefinically-unsaturated carboxylic acids, said cation exchange copolymer being maintained completely out of contact with said solid soiled materials in a separate area from the washing area, said wash liquor at some time during said recycling containing soluble washing and cleaning compounds and washing said solid materials while continuing the recycling of the wash liquor through said cation exchange copolymer, wherein the total amount of washing liquor is continuously or intermittently cyclically circulated from the washing area through the separate area with the cation exchange copolymer and then back to the washing area at least five times during the cleaning process, and during this period the direction of flow of said wash liquor through said cation exchange copolymer is reversed repeatedly, and where the amount of the cation exchange copolymer is sufficient to substantially soften the washing solution, and said washing solution contains from 0.2 to 10 gm/liter of other soluble washing and cleaning compounds including from 0.05 to 2 gm per liter of a water-soluble calcium-binding sequestrant, whereby said cation exchange copolymer is never in contact with said solid materials.

The term "completely out of contact with said solid soiled materials in a separate area from the washing area" means that the cleaning solution cycled through the cation exchanger passes, independently of the respective flow direction through a filter which is impenetrable by the cation exchanger before it is again brought in contact with the material to be cleaned. The filter is to be impenetrable for those particles which, due to their size, settle relatively fast in the cleaning solution and thus can precipitate on the fiber or on the dishes to be washed or other material. Solid particles which due to their much smaller size form a stable suspension in the cleaning solution, and as a result do not tend to form adhering precipitates on the material to be cleaned or, respectively, on the cleaning units, can pass through the filter.

According to the invention, however, cation exchange copolymers are preferred which are free from very fine-grained components, i.e., of those of a grain size of less than 5μ and whose average grain size is about 10μ, and in particular above 30μ, and especially above 50μ. All grain sizes are after being swollen in water. Suitable granulated materials have, for example, a grain spectrum of 10μ to 2 mm with a maximum at 10μ to 200μ after swelling in water. Particle sizes of over 2000μ should be avoided, since the rate of ion exchange is slowed with large particles.

The optional softening of the tap water wash liquid, which precedes the addition of washing and cleaning agent, can be done by having the entire charge of the fresh water flow with the cation exchanger into the filter device and collecting the cation exchanger in the adsorption device while passing the water into the washing area. This operation is sufficient to materially reduce the hardness of the wash water before addition of the surface-active agents and water-soluble sequestrants. If desired, further softening can be effected by recycling the wash water until the desired degree of softness is obtained before charging the detergent.

Of particular advantage, is the use of a detergent composition which contains an anionic surface-active compound and a substoichiometric amount of a water-soluble sequestering agent. The aqueous wash solution should contain from 0.1 to 1 gm/liter of an anionic surface-active compound and 0.05 gm/l. to 2 gm/l. of a water-soluble sequestering agent for calcium as an assistant or adjuvant for the ion-exchange agent.

It is usually necessary that the amount of cationic exchange copolymer used be sufficient to bind substantially all of the hardness present.

The process of the invention can be performed in a conventional machine washer which comprises in combination a tub adapted to contain the objects to be washed, a conduit having a pump therein adapted to circulate washing solution from one portion of said tub to another portion of said tub, and a special vessel in said conduit adapted to completely contain said ion-exchange agent having a particle size in excess of 20μ even when the flow direction is reversed. The vessel is hereinafter sometimes for convenience termed a "filter", but it will be understood that in each instance it also performs the function of binding the ions which cause hardness in water.

In practicing the method of the invention, a cation exchanger copolymer is employed having a particle size of between 10μ and 2000μ, a calcium binding capacity of at least 2 mVal per gram, preferably at least 8 mVal/gm.

The water-insoluble cation exchange polymers suitable for carrying out the method are known. These are, for example, the water-insoluble copolymers of acrylic, methacrylic, crotonic, maleic, fumaric, and itaconic acid with olefinically-polyunsaturated compounds, such as alkadienes, dialkenylbenzenes, dialkenyl ethers, dialkenyloxy-alkanes and esters of unsaturated acids with polyols, as they are described, for example, in published German Patent Application DOS No. 2,411,466, which corresponds to U.S. patent application Ser. No. 446,153, now abandoned.

They can be present, for example, in the form of swellable particles or as open-pored foams, sponges or fleeces. A variety of suitable materials of this type are disclosed in published German Patent Applications DOS No. 2,216,467 and DOS No. 2,307,923. Also suitable are graft polymers of olefinically-unsaturated carboxylic acids, such as the above acids, onto natural or synthetic fibers, e.g., grafts of acrylic acid or methacrylic acid on cellulose. Methods for making these grafts are shown in U.S. Pat. No. 3,721,627 and German Application DOS No. 2,330,026. These can also be made by the known ceric ion graft polymerization method. The water-insoluble cation exchange polymers can be present in the form of their alkali metal salts, particularly as sodium salt, also as their lithium or potassium salts, or ammonium salts, as well as salts of organic ammonium bases, for example, alkylolamines having 2 to 3 carbons in each alkylol, such as mono-, di-, or triethanolamine, or in the form of the free acids.

The amount of water-insoluble cation exchange polymer should be so selected that the residual hardness of the cleaning solution attains in the course of the washing process a value of 0.5 to 20 mg CaO/liter. Otherwise stated, the amount normally used is that which decreases the hardness of the water by at least about 50%, which is about the least amount needed to render the process economical.

A method of improving the filtering capacity of the cation exchanger, if desired, consists in using filter aids, like kieselguhr (silica), diatomaceous earth, pumice powder, cellulose, or finely ground plastic foam. The cation exchanger can also be deposited or adsorbed on these porous materials, improving the filtering capacity during the production or after in order to increase this way the particle size.

The process of the present invention is ordinarily used with waters which have a normal hardness in excess of about 80 mg of CaO equivalent per liter, i.e., with waters which have an initial hardness of the amount or which develop this hardness as the washing proceeds.

The amount of cation exchanger required to obtain a good washing or cleaning effect depends, on the one hand, on its calcium binding power, and on the other hand, on the amount of dirt in the materials to be washed and on the hardness and the amount of water used.

In order to obtain an optimum washing or cleaning effect, it is advisable to use a certain excess of cation exchanger, particularly in the case of greatly soiled substrates, in order to completely or partly bind the hardness formers contained in the released dirt. In most instances, accordingly, the amount used per cleaning cycle ranges between 0.2 to 10 gm of cation exchanger, particularly 1 to 6 gm of cation exchanger per liter of wash water, so as to maintain the hardness of the wash solution as close to zero as is practicable.

A water-soluble substance is added to the aqueous solution of detergent which exerts a sequestering (i.e., a complex-forming) and/or precipitating effect on the calcium obtained in the soil. Suitable as sequestering agents for calcium for the purposes of the invention are also substances with such a low sequestering power that they were not considered heretofore as typical sequestering agents for calcium, but these compounds are frequently capable of delaying the precipitation of calcium carbonate from aqueous solutions. The sequestrants or precipitants binding calcium ions can be present in substoichiometric amounts, related to the hardness formers present. They act as "carriers", that is, their calcium salts are transformed into soluble salts by contact with the ion exchanger and they are thus again available as sequestrants.

Preferably small amounts of sequestrants or precipitants for calcium are used, e.g., 0.05 to 2 gm/liter in order to speed up or improve the removal of impurities. Particularly, amounts of 0.1 to 1 gm/liter are used. Substantially larger amounts can also be used, but in the case of phosphorus-containing sequestrants or precipitants the amounts should be so selected that the phosphorus load of the waste water is less than with the use of the customary detergents based on triphosphate.

The sequestrants or precipitants comprise those of an inorganic nature such as the water-soluble alkali metal (particularly the sodium) and ammonium pyrophosphates, triphosphates, higher polyphosphates, and metaphosphates.

Organic compounds which act as sequestrants or precipitants for calcium include the water-soluble polycarboxylic acids, hydroxycarboxylic acids, aminocarboxylic acids, carboxyalkyl ethers, polyanionic polymers and water-soluble salts thereof, particularly the polymeric carboxylic acids and the phosphonic acids, which are used as acids, alkali metal or aluminum salts and preferably as sodium salts.

Examples of polycarboxylic acids are dicarboxylic acids of the general formula $$HOOC—(CH_2)_n—COOH$$

wherein n=0 to 8, in addition, maleic acid, methylenemalonic acid, citraconic acid, mesaconic acid, itaconic acid, acyclic polycarboxylic acids with at least three carboxyl groups in the molecule, such as, for example, tricarballylic acid, aconitic acid, ethylene tetracarboxylic acid, 1,1,3,3-propanetetracarboxylic acid, 1,1,3,3,5,5-pentanehexacarboxylic acid, hexanehexacarboxylic acid, cyclic di- or polycarboxylic acids, such as, for example, cyclopentanetetracarboxylic acid, cyclohexanehexacarboxylic acid, tetrahydrofurantetracarboxylic acid, phthalic acid, terephthalic acid, benzene-tri-, tetra- or pentacarboxylic acid, as well as mellitic acid.

Examples of hydroxymono- or polycarboxylic acids are glycolic acid, lactic acid, malic acid, tartronic acid, methyl tartronic acid, gluconic acid, glyceric acid, citric acid, tartaric acid, and salicylic acid.

Examples of aminocarboxylic acids are glycine, glycylglycine, alanine, asparagine, glutamic acid, aminobenzoic acid, iminodi- or triacetic acid, (hydroxyethyl)-iminodiacetic acid, ethylenediaminetetaacetic acid, (hydroxyethyl)-ethylenediaminetriacetic acid, diethylenetriaminepentaacetic acid, as well as higher homologues, which can be obtained by polymerization of an N-aziridylcarboxylic acid derivative, e.g., acetic acid, succinic acid, tricarballylic acid and subsequent saponification or by condensation of polyimines with a molecular weight of 500 to 10,000 with salts of chloroacetic or bromoacetic acid.

Examples of carboxyalkyl ethers are 2,2-oxydisuccinic acid and other ether polycarboxylic acids, particularly polycarboxylic acids containing carboxymethyl ether groups which comprise corresponding derivatives of the following polyvalent alcohols or hydroxycarboxylic acids, which can be completely or partly etherified with the glycolic acid:

glycol
di- or triglycols
glycerin
di- or triglycerin
glycerin monomethyl ether
2,2-dihydroxymethyl-propanol
(1,1,1-trihydroxymethyl)-ethane
(1,1,1-trihydroxymethyl)-propane
erythrite
pentaerythrite
glycolic acid
lactic acid
tartronic acid
methyltartronic acid
tartaric acid
trihydroxy glutaric acid
saccharic acid
mucic acid.

As transition types to the polymeric carboxylic acids are the carboxymethyl ethers of sugar, starch and cellulose.

Among the polymeric carboxylic acids, the polymers of acrylic acid, hydroxyacrylic acid, maleic acid, itaconic acid, mesaconic acid, aconitic acid, methylene malonic acid, citraconic acid, etc., the copolymers of the above-mentioned carboxylic acids with each other or with ethylenically unsaturated compounds, such as ethylene, propylene, isobutylene, vinyl alcohol, vinyl methyl ether, furan, acrolein, vinyl acetate, acrylamide, acrylonitrile, methacrylic acid, crotonic acid, etc., such as the 1:1 copolymers of maleic acid anhydride and ethylene or propylene or furan, play a special role.

Other polymeric carboxylic acids of the type of the polyhydroxypolycarboxylic acids or polyaldehydropolycarboxylic acids are substantially substances composed of acrylic acid and acrolein units or acrylic acid and vinyl alcohol units which can be obtained by copolymerization of acrylic acid and acrolein or by polymerization of acrolein and subsequent Cannizzaro reaction, if necessary, in the presence of formaldehyde.

Examples of phosphorus-containing organic sequestrants are alkane-polyphosphonic acid, amine- and hydroxyalkane polyphosphonic acids and phosphono-carboxylic acids, such as:

methane diphosphonic acid
propane-1,2,3-triphosphonic acid
butane-1,2,3,4-tetraphosphonic acid,
polyvinyl phosphonic acid
1-amino-ethane-1,1-diphosphonic acid
1-amino-1-phenyl-1,1-diphosphonic acid
aminotrimethylene phosphonic acid
methylamine- or ethylamine-dimethylene phosphonic acid
ethylene-diaminetetramethylene phosphonic acid
1-hydroxyethane-1,1-diphosphonic acid
phosphonoacetic acid
phosphonopropionic acid
1-phosphonoethane-1,2-dicarboxylic acid
2-phosphonopropane-2,3-dicarboxylic acid
2-phosphonobutane-1,2,4-tricarboxylic acid
2-phosphonobutane-2,3,4-tricarboxylic acid, as well as copolymers of vinyl phosphonic acid and acrylic acid.

The process of the present invention permits a reduction in the use of phosphorus containing inorganic or organic sequestrants or precipitants to a content of inorganically or organically combined phosphorus in the treatment liquors to less than 0.6 gm/liter, and preferably to less than 0.3 gm/liter, or the working of the process completely without phosphorus-containing compounds.

The process of the present invention is usefully applied to waters of any given objectionable level of hardness.

Apart from washing textiles, which is the preferred field of application, the method and the device according to the invention are also suitable for any other cleaning operations where it is possible or of advantage to return or regenerate the tap water or the cleaning solution. These applications comprise the cleaning of instruments, apparatus, pipe lines, boilers and vessels of any material, such as glass, ceramic material, enamel, metal or plastic. An example is the industrial cleaning of bottles, drums and tank cars. The method is also particularly suitable for use in commercial or household dishwashing machines.

Depending on the use, customary surfactants, builder substances which increase the cleaning power, bleaching agents, as well as compounds which stabilize or activate such bleaching agents, soil-suspension agents or greying inhibitors, optical brighteners, biocides or bacteriostatic substances, enzymes, foam inhibitors, corrosion inhibitors and substances regulating the pH value of the solution can be present in the washing and cleaning process. Such substances, which are normally present in varying amounts in the washing, rinsing and cleaning agents, are listed specifically in Ser. No. 639,465.

When using one or more of the above-mentioned substances which are generally present in cleaning liquors, the following concentrations are preferably maintained:

| Grams per liter | |
|---|---|
| 0.1 to 2.5 | surfactants |
| 0.01 to 3 | sequestrants |
| 0 to 3 | other builder substances |
| 0 to 0.4 | active oxygen or equivalent amounts of active chlorine. |

The pH of the treatment liquors can range from 6 to 13, depending on the substrate to be washed or cleaned; preferably it is between 8.5 and 12.

The treatment temperature can vary within wide limits and is between 20° C. and 100° C. Since the washing and cleaning effect is already very high at low temperatures, that is, between 30° C. and 40° C., and exceeds that of conventional detergents and methods, it is possible to wash very delicate fabrics in this range, e.g., those of wool or silk or very fine porcelain dishes with a very delicate overglaze or gold trim without damaging them.

The washing or cleaning time at the anticipated treatment temperature depends on the degree of soiling, the exchange rate, and the output of the pump. It can, therefore, vary within wide limits, for example, from five minutes or two hours. Preferably, it is between 10 and 60 minutes as this is usually sufficient to effect substantially complete removal of soil. The output of the pump and of the filter are preferably so selected that the cleaning solution is circulated at least twice during the washing period. The washing solution should pass at least five times and preferably ten to about fifty times through the filter charged with the cation exchanger. This output should also be achieved if the filter becomes partially clogged by the deposited material and has become difficult to penetrate.

It is, therefore, advisable to use pumps which still assure a sufficient output at a certain back-pressure, e.g., of 1 to 2 atmospheres above normal.

The pore size of the filter depends on the particle size of the cation exchanger. Since the deposited material or the additionally used filter aid also has a filter effect, the pore size can be greater than corresponds to the particle size of the fine portions in the interest of a lower flow resistance.

The device (i.e., the apparatus) according to the invention consists at least of the following components:

(a) A washing or cleaning unit or dishwashing unit which may be of a conventional or modified construction, (b) A cycle system equipped with a circulating pump, (c) At least one adsorption device, such as a filter unit in the cycle system for completely containing the calcium binding agent.

Moreover, the following arrangements have proved successful for the practice of the process of the invention:

(d) A fresh water inlet, connected with the adsorption device, and (e) A feeding or proportioning device for the washing and cleaning agent, disposed in the cycle system.

The invention is further illustrated by the drawings wherein:

FIGS. I and II are diagrammatic cross-sections of filter embodiments for practicing the process according to the present invention;

FIG. III is a partial cross-section of another filter embodiment, and

FIG. IV is a flow diagram of the process of the invention.

FIG. I shows diagrammatically a counter-current filter in transverse section. It consists of the filter housing 1, the filter chamber 2, which is defined by the two filter plates 3 and 4, the filling pipe 5 and the drain pipe 6 provided with a check valve 15, for the cation exchanger, as well as the two connections 7 and 8 for the cycled cleaning solution. For operation the alumino-silicate is transferred into the filter chamber 2 through pipe 5. In the first phase the cleaning liquid enters the filter through the inlet 7 and leaves it through the connection 8. In the second phase the liquid is conducted in the opposite direction. As a result of the flow reversal, the material previously deposited on the filter is lifted off and loosened. By repeating this flow reversal several times, the filter remains penetrable. After termination of the washing process, the bottom valve 15 having been opened, the cation exchanger is discharged through the drain pipe 6. For complete cleaning of the filter, the cleaning solution no longer needed is conducted either alternately or simultaneously through the inlets 7 and 8 into the filter and evaucated via pipe 6.

The illustrated principle may be modified in various ways. Thus it is possible, for example, to integrate the filter in a separate wash liquor container of the washing or dishwashing machine. With such a concentration, one side of the filter housing with the associated feed pipe, in the drawing, for example, the right housing side with pipe 8, may be omitted or replaced by a sieve plate directly connected with the wash liquor container. Further the filter may be arranged horizontally. Such an arrangement has the advantage that even with partial filling of the filter chamber the lower filter surface is always completely covered with cation exchanger and through-flow without ion exchange in the area of cavities is avoided. The complete evacuation of spent cation exchanger from the horizontally arranged filter chamber can be facilitated by additionally introducing the outflowing wash liquor into the filling pipe 5.

The arrangement has the disadvantage, a minor one, however, that always only one half of the existing filter surface is available for the actual filtration process. The other half of the filter surface, through which the cycled wash liquor flows into the filter chamber, is not used for filtration in the respective cycle and causes an additional flow resistance.

An arrangement which avoids this disadvantage is illustrated diagrammatically in FIG. II. It consists of the filter jacket 9, within which an outer filter surface 10 and an inner filter surface 11 are arranged, which may consist, for example, of plain filter plates or two concentric filter cartridges. The filter chamber 12 intended to receive the cation exchanger can be charged with the exchanger through the filling pipe 13 and be evacuated through the drain pipe 14 provided with a valve 15. When using a comparatively fine-grained cation exchanger, the latter may alternatively be flushed into the filter chamber via the drain pipe 14. In this case the filling pipe 13 may be omitted. The connections 16 and 17 serve to admit and to remove the cycled cleaning liquid.

Operation of the counter-current filter during the so-called "work cycle" occurs by introducing the circulated cleaning liquid through the inlet 14 into the filter chamber, with valve 15 open, after the cation exchanger has been placed in the filter chamber 12. The cation exchanger is maintained in suspension and whirled intensively by the inflowing wash liquid. The liquid passes through the filter surfaces 10 and 11 and leaves the filter in a clarified state through the two connections 16 and 17. The two partial streams are combined and go back into the system. The cleaning of the filter surfaces 10 and 11 from deposited material by flow reversal occurs intermittently. First the valve 15 is closed and the cleaning solution is introduced through the conduit 16. The liquid travels through the filter surface 10, detaches the coating on the inside, passes through the filter surface 11 and flows out through the connection 17. As soon as the filter surface 11 is free of the coating, which usually takes only a few seconds or fractions of a second, the cleaning liquid is let in through the inlet 17 with valve 15 still closed, and after passage through the filter surfaces 11 and 10 is returned to the system via connection 16.

After the cleansing of the filter surface 11, the work cycle starts again, in which the liquid stream is introduced into the filter through inlet 14 with valve 15 open and is let out via the connections 16 and 17. Naturally the sequence during the cleansing may be changed, i.e., first the filter surface 11 and then the filter surface 10 is cleansed. The evacuation of spent cation exchanger from the filter chamber after termination of the washing process occurs by means of the water flowing in via the connections 16, 17 and possibly also 13 with valve 15 open, via pipe 14.

FIG. III shows a counter-current filter which has proved particularly successful in practice. It consists of two conical housing halves 18 and 19, which are firmly connected together through a flange 20 provided with seal rings and tightening screws. The housing encloses the two outer chambers 21 and 22, which are sealed from each other by the flange. The filter basket 23 consists of a colander type perforated double cone, which imparts the necessary mechanical strength to the filter element applied against the inside, and consisting, for example, of textile material, a fiber mat or a fine wire mesh. The inner filter chamber 24 can be charged with cation exchanger through the filling pipe 25. When using a sufficiently fine-grained cation exchanger, the filling may occur also through the drain pipe 27 provided with a cone valve 26. The feed pipe 28 communicates with the outer chamber 21, feed pipe 29 with the outer chamber 22.

The quantity of cation exchanger should be expediently selected such that the cavity 24 is filled no more than 80%, preferably 20 to 60%. During the so-called work cycle, the circulated cleaning solution is conveyed into the cavity 24 through inlet 27 with valve 26 open, there occurring, due to the construction of the filter, an intensive whirling of the ion exchanger and consequently a rapid and effective ion exchange. After filtration, the liquid enters the two outer chambers 21 and 22, whence the two partial streams, having left the filter, are combined via the connections 28 and 29, and are returned to the material to be cleaned. The cleansing of the filter from deposited material by flow reversal occurs, similarly as with the filter construction of FIG. II, in two steps. First, with valve 26 closed, the liquid is introduced into the outer chamber 21 via connection 28. It passes through the lower filter cone, there detaches the coating, and leaves the filter via the upper filter cone as well as the outer chamber 22 and the connection 29.

For cleansing the upper filter cone, again with valve 26 closed, the liquid is introduced into the outer chamber 22 via connection 29, whence it is then discharged through the lower filter cone via the outer chamber 21 and connection 28. The two steps can, of course, be carried out also in the reverse order. After the cleansing of both filter halves, the work cycle starts anew. Evacuation of the filter chamber after termination of the washing process occurs in that the cleaning or washing liquid is admitted via the connections 28 and 29 and the cation exchanger is discharged, with valve 26 open, via connection 27 with simultaneous flushing out of the cation exchanger.

The frequency and duration of the flow reversal or cleansing of the clogged filters depend on a number of factors. When using a fine-grained cation exchanger, the flow reversal will occur more frequently during a washing process than when using one of coarser grain. On the other hand, when using a fine-grained material, the washing process can take less time in all, due to the faster exchange reaction. Another factor is the construction of the filter. When using a simple counter-current filter according to FIG. 1, filter surfaces of equal size are available in both flow directions, for which reason the same interval of time is expediently selected for the stroke and counterstroke. But when using a counter-current filter, according to FIG. II, and in particular FIG. III, it will be desirable, in view of the fact that during the intermittent cleansing of the filter surface only half the surface is available for the actual filtration process, to select the work cycle five to ten times as long as the internval for the cleansing of the filter. During a washing and cleaning process where the cleaning liquid is cycled a total of about 30 to 90 minutes, therefore, when using a counter-current filter according to FIG. III, a flow reversal is necessary at intervals of about 2 to 15 minutes, preferably 3 to 10 minutes, the duration of the flow reversal being about 1 to 30 seconds, more particularly 2 to 15 seconds per filter surface.

It is not necessary in all cases to reverse the flow direction by controlled measures, for example, by actuation of switching members. It may suffice to suddenly stop the flow at a suitable point of the conduit system. The back pressure then building up leads briefly to a sudden flow reversal and knocking off of the filter mud.

The point in time of the respective flow reversal during a washing process can be programmed by an automatic control, so that the change of cycle occurs according to a fixed scheme. Alternatively, a pressure-dependent control may be used which records the flow or respectively the flow resistance building up due to increasing clogging of the filter and brings about a reversal of the flow direction when a permissible value is exceeded.

It has been found to be expedient to arrange a second filter in the cycle system in addition to the countercurrent filter intended to receive the polymeric cation exchanger. This so-called dirt filter is to prevent lint and coarse impurities forming during the washing and cleaning process from getting into the counter-current filter, clogging or blocking valves and feed lines, and to remove them beforehand from the cycled cleaning solution. Further the dirt filter can be used for collecting the cation exchanger discharged from the counter-current filter after termination of the washing process. The collected cation exchanger is removed from this dirt filter at an easily accessible point and discarded. The dirt filter may have relatively large pores and be penetrable by very fine-grained material, as the latter is harmless because of its only slight tendency to deposit in the conduit pipes. Instead of a filter, a correspondingly dimensioned centrifuge, for example, a continuously operating tube centrifuge, may be used.

The execution of the washing process will be explained in the example of the flow diagram shown in FIG. IV. First the filling duct 30 is filled with the polymeric cation exchanger. Then it is flushed into the filter 33 via the inlet 32 with the aid of the fresh water flowing in from the feed line 31. For reasons of simplified illustration, a counter-current filter according to FIG. I is shown, which, of course, may be replaced by differently designed counter-current filters. The fresh water presoftened by interaction with the ion exchanger, having passed through the filter, runs via the lines 34 and 35 to the switching 36 and thence via line 37 to the feed device 38 containing the washing or cleaning agent. After dissolution of the washing or cleaning agent, the solution runs via the connection 39 into the cleaning tank 40, which is loaded with the material to be cleaned, and thence via line 41 into the dirt filter 42. The cleaning liquid, freed from coarse dirt particles and lint, flows via the connection 43 to the circulating pump 44, whence it is transported via the valve 45 and line 46 to the switching device 36. Thence it flows alternately via line 34 into the filter 33 and back into line 35, or respectively, after switching, in opposite direction via line 35 into filter 33 and thence via line 34 back again to the switching device. Thereafter the regenerated liquid is again cycled over the line sections or units 37, 39, 40, 41, 42, 43, 44, 45 and 46.

After completing the washing process, the cleaning solution is transported into the sewer mains via the drain pipe 47, valve 45 having been switched. The cation exchanger is removed from the counter-current filter 33 after valve 48 has been opened. The cation exchanger goes through line 49 to the dirt filter 42 and is collected there. Discharge of the exchanger and complete evacuation is promoted by maintaining a liquid circulation in the units or conduits 44, 45, 46, 36, 34, 35, 33, 48, 49, 42 and 43 by actuation of pump 44 for a short time. Transfer of the cation exchanger and cleaning of the counter-current filter can be carried out immediately after termination of the washing process, i.e., before the spent cleaning solution is pumped off. Preferably, however, the procedure is first to remove the bulk of the washing liquid and only then to flush out the counter-current filter. The advantage of the last-named procedure is that the dirt filter is charged with cation exchanger only after the bulk of the cleaning solution has drained, and clogging of the filter pores is avoided.

Another possibility consists in that the washing or cleaning solution used is pumped off completely, the cation exchanger being at first left in the counter-current filter, then passing through the fresh water needed for the first and possibly also the second and third rinse cycles. As the exchanger capacity of the cation exchanger is generally not yet exhausted after the cycle wash, this enables the rinse water to be partially softened. This has an advantageous effect on the so-called secondary wash effect, i.e., the graying and incrustation of the fabric, which is known to increase with the duration of use and the number of launderings, is clearly less than when rinsing with hard water. The cation exchanger is then discharged from the counter-current filter with the draining rinse water of the first or second rinse cycle and, as shown above, collected on the dirt filter.

The advantage of the arrangement described in FIG. IV is that in the circulation system in which the wash liquor tank, the dirt filter and the circulating pump are installed, the cleaning liquid is transported always only in one direction and a flow reversal occurs only in the counter-current filter. This results in a directed substance transport, starting from the material to be cleaned toward the dirt filter and counter-current filter, whereby an especially good laundry result is obtained. Naturally, the principle illustrated can be varied and modified in many ways.

The invention is not limited to the arrangement represented here. Rather these can be supplemented and modified in many ways.

The invention is further illustrated by the examples which follow. These examples are illustrative of the process of the invention. However, they are not to be construed as limitations thereof.

EXAMPLES

The following water-insoluble cation exchange polymers were employed in the examples:

I. An exchanger in the form of sodium salt, obtained by copolymerizing 95 mol % of acrylic acid and 5 mol % of hexamethylene-bis-acrylamide, with a capacity of 8.2 mVal/gm. The resin had a mean particle size (unswollen) of 0.05 mm and of about 0.15 mm when swollen in water.

II. A polyacrylate exchanger (Na salt) prepared according to Example 2 of German DOS No. 2,411,466 in the form of a finely ground open-pored foam with a particle size of 0.1 mm (unswollen) and a cation binding capacity of 10.5 mVal/gm.

EXAMPLES 1 to 6

The following illustrates the washing of a variety of fabrics carrying a standard soil (including iron soil) in water having a high concentration of calcium hardness components and containing anionic detergents. The washing was performed in a commercial drum washing machine with horizontally mounted front-loading drum having a capacity of 4 kg of dry laundry. According to the diagram shown in FIG. IV, the drain pipe inserted in the bottom of the wash liquor container was connected with a lint filter (dirt filter), from which a conduit led to the wash liquor pump and thence via a multiway cock (switching device) to a double cone filter according to FIG. III. The return line from the filter was integrated in the hollow shaft of the drum, by means of which the wash liquor was conducted directly to the dirty laundry.

The inner chamber of the double cone filter had a volume of about 2000 cc and was loosely filled with the cation exchanger which after swelling was 60% filled. The wash liquor quantity was 20 liters and the delivery of the pump was 10 liters per minute, so that the wash liquor was circulated on the average once in about two minutes. After every six minutes circulation of the wash liquor, the flow direction was reversed for ten seconds first in the lower portion and then in the upper portion of the filter. This alternation occured 15 times in all during the 90-minute washing process. Due to these measures, the filter remained easily penetrable during the entire washing process.

Before the start of the washing process, the fresh water was, as shown diagrammatically in FIG. IV, passed first through the filter charged with cation exchanger and was thus softened from an initial hardness of 16° dH to a hardness of 3.8° dH. After the cleaning liquid had been pumped off, also the fresh water needed for the first rinse cycle was passed over the cation exchanger remaining in the counter-current filter, being thereby softened from the initial hardness of 16° dH to 9.3° dH. In the following rinse cycles, the rinse water was conducted directly to the textile material. The flushing out of the cation exchanger from the counter-current filter and transfer into the dirt filter occurred with the draining rinse water of the fourth rinse cycle, to avoid premature clogging of this filter.

The cation exchanger employed was prepared according to I above by the copolymerization of 92 mol % of acrylic acid and 8 mol % of hexamethylene-bis-acrylamide and had a calcium exchange capacity of 8.1 mVal/gm. After grinding, it had an average particle size of 0.005 to 0.03 mm (dry) and after swelling in water, 0.01 to 0.1 mm. The washing machine was loaded with 3 kg of clean fill-up laundry as well as two textile samples each (20×20 cm) of cotton (C), finished cotton (F.C.), and a blend of 50% polyester and 50% finished cotton (P/C), the textile samples having been artificially soiled with skin fat, kaolin, iron oxide black and carbon black. This simulates the soil of naturally soiled garments. The washing temperature was 90° C. for the cotton and 60° C. for the finished cotton and blended fabric.

The following washing agent components and additives in grams per liter of wash liquor were used:

| Grams/liter | WASHING AGENT A |
|---|---|
| 0.5 | Na n-dodecylbenzene sulfonate |
| 0.17 | Ethoxylated tallow fatty alcohol (14 mols ethylene oxide) |
| 0.27 | Na soap (tallow fatty acids/ behenic acid 1:1) |
| 0.015 | Na ethylenediaminetetraacetate (EDTA) |
| 0.25 | Na silicate ($Na_2:SiO_2$ = 1:3.3) |
| 0.11 | Na carboxymethylcellulose (Na CMC) |
| 2.0 | Sodium perborate tetrahydrate |
| 0.15 | Magnesium silicate |
| 0.2 | Sodium sulfate |

| Grams/liter | WASHING AGENT B |
|---|---|
| 0.5 | Ethoxylated oxoalcohol $C_{14}$–$C_{17}$ (12 mols ethylene oxide) |
| 0.17 | Ethoxylated tallow fatty alochol (5 mols ethylene oxide) |
| 0.27 | Na soap (tallow fatty acids/ behenic acid 1:1) |
| 0.015 | Na ethylenediaminetetraacetate (EDTA) |
| 0.25 | Na silicate ($Na_2:SiO_2$ = 1:3.3) |
| 0.11 | Na carboxymethylcellulose (Na CMC) |
| 2.0 | Sodium perborate tetrahydrate |
| 0.2 | Magnesium silicate |
| 0.2 | Sodium sulfate |

The other additives are given in Table 1. The abbreviation Na TPP stands for sodium tripolyphosphate.

After termination of the washing process and pumping off of the wash solution, the cleaned goods were rinsed with tap water four times and ended by spinning to dryness. The percentual remission values of the textile samples, determined photometrically, are compiled in the following Table 2.

TABLE 1

| Example | Washing Agent | Cation Exchanger gm/1 | additive gm/1 | % Remission C | F.C. | P/C |
|---|---|---|---|---|---|---|
| — | A | — | — | 55 | 57 | 52 |
| 1 | A | 2.5 | 0.4 Na TPP | 82 | 74 | 71 |
| 2 | A | 2.5 | 0.4 Na Citrate | 82 | 74 | 71 |
| 3 | A | 2.5 | 0.4 Na TPP 0.4 Na Citrate | 83 | 75 | 72 |
| 4 | B | 2.5 | 0.4 Na TPP | 83 | 77 | 77 |
| 5 | B | 2.5 | 0.4 Na Citrate | 83 | 77 | 77 |
| 6 | B | 2.5 | 0.4 Na TPP 0.4 Na Citrate | 84 | 78 | 78 |

These results show the improvement in operating according to the invention.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. A method for machine washing and cleaning of solid soiled materials with aqueous wash liquor in the presence of water-insoluble cation exchange agents which are capable of binding the hardness components of the water and the soil, comprising withdrawing and recycling the wash liquor in contact with said solid soiled materials in a washing area through a water-insoluble cation exchange copolymer in particulate state having a swelled average particle size of between 10μ and 2000μ and having a calcium binding power of at least 2 mVal/gm, said copolymer being a copolymer or graft polymer derived from mono-olefinically-unsaturated carboxylic acids, said cation exchange copolymer being maintained completely out of contact with said solid soiled materials in a counter-current filter separate from the washing area, said wash liquor being passed through a lint filter before passing through said counter-current filter and then recycled to the washing area and said wash liquor at some time during said recycling containing soluble washing and cleaning compounds and washing said solid materials with the wash liquor while continuing the recycling of the wash liquor through said cation exchange copolymer, wherein the total amount of washing liquor is continuously or intermittently cyclically circulated from the washing area through the separate counter-current filter with the cation exchange copolymer and then back to the washing area at least five times during the washing process, and during said recycling of the wash liquor the direction of flow of said wash liquor through said cation exchange copolymer is reversed repeatedly during a wash period of 30 to 90 minutes, the direction of flow is reversed at intervals of 2 to 15 minutes, and where the amount of the cation exchange copolymer is sufficient to substantially soften the washing liquor, and said washing liquor contains from 0.2 to 10 gm per liter of other soluble washing and cleaning compounds including from 0.05 to 2 gm per liter of a water-soluble calcium-binding sequestrant, whereby said cation exchange copolymer is never in contact with said solid materials.

2. The method of claim 1 wherein said cation exchange copolymer has a particle size of over 30μ in the swollen state.

3. The method of claim 1 wherein said cation exchange copolymer has a particle size of from 50μ to 2000μ with a maximum in the range of from 100μ to 1000μ in the swollen state.

4. The method of claim 1 wherein said cation exchange copolymer has a particle size of from 10μ to 100μ in the swollen state.

5. The method of claim 1 wherein said solid soiled materials are textiles.

6. The method of claim 1 wherein said cation exchange copolymer has a calcium binding power of at least 8 mVal per gram.

7. The method of claim 1 wherein said other soluble washing and cleaning compounds include an anionic surface-active compound.

8. The method of claim 1 wherein said other soluble washing and cleaning compounds include a nonionic surface-active compound.

9. A method for machine washing and cleaning of solid soiled materials with aqueous wash liquor in the presence of water-insoluble cation exchange agents which are capable of binding the hardness components of the water and the soil, comprising (a) withdrawing and recycling the wash liquor in contact with said solid soiled materials in a washing area through a water-insoluble cation exchange copolymer in particulate state having a swelled average particle size of between 10μ and 2000μ and having a calcium binding power of at least 2 mVal/gm, said copolymer being a copolymer or graft polymer derived from mono-olefinically-unsaturated carboxylic acids, said cation exchange copolymer being maintained completely out of contact with said solid soiled materials in a counter-current filter separate from the washing area, said wash liquor being passed through a lint filter before passing through said counter-current filter and then recycled to the washing area and said wash liquor at some time during said recycling containing soluble washing and cleaning compounds, (b) washing said solid materials with the wash liquor while continuing the recycling of the wash liquor through said cation exchange copolymer, wherein the total amount of washing liquor is continuously or intermittently cyclically circulated from the washing area through the separate counter-current filter with the cation exchange copolymer and then back to the washing area at least five times during the washing process, and during said recycling of the wash liquor the direction of flow of said wash liquor through said cation exchange copolymer is reversed repeatedly, and where the amount of the cation exchange copolymer is sufficient to substantially soften the washing liquor, and said washing liquor contains from 0.2 to 10 gm per liter of other soluble washing and cleaning compounds including from 0.05 to 2 gm per liter of a water-soluble calcium-binding sequestrant, and (c), after said soiled solid materials are washed, passing said cation exchange copolymer in said counter-current filter to said lint filter between said washing area and said counter-current filter without passing into said washing area.

* * * * *